United States Patent [19]

McDonald et al.

[11] Patent Number: 4,590,364

[45] Date of Patent: May 20, 1986

[54] CONTAINER COUNTING APPARATUS

[75] Inventors: Theodore R. McDonald; Randall H. Hetzner, both of Saginaw, Mich.

[73] Assignee: Fischer-Flack, Inc., Saginaw, Mich.

[21] Appl. No.: 511,409

[22] Filed: Jul. 7, 1983

[51] Int. Cl.[4] ..... B61L 1/16

[52] U.S. Cl. ..... 235/98 C; 235/98 R; 377/53; 221/7; 221/11

[58] Field of Search ..... 235/98 R, 98 C, 94 R; 377/53, 61, 11; 221/2, 7

[56] References Cited

U.S. PATENT DOCUMENTS

| | | | |
|---|---|---|---|
| 233,245 | 10/1880 | Hayward | 414/108 |
| 1,416,763 | 5/1972 | Thom | 198/445 |
| 1,582,820 | 4/1926 | Hungerford | 198/396 |
| 3,193,196 | 7/1965 | Merrill et al. | 235/98 R |
| 3,306,425 | 2/1967 | Rapp, Jr. et al. | 198/399 |
| 3,730,386 | 5/1973 | Monsees | 221/7 |
| 3,749,240 | 7/1973 | Spears et al. | 209/631 |
| 3,892,658 | 7/1975 | Benowitz | 209/213 |
| 3,926,792 | 12/1975 | Buford | 209/636 |
| 3,935,947 | 2/1976 | Barrett | 209/636 |
| 3,985,647 | 10/1976 | Smith | 209/218 |
| 4,225,047 | 9/1980 | Grubman | 209/544 |

*Primary Examiner*—L. T. Hix
*Assistant Examiner*—Brian W. Brown
*Attorney, Agent, or Firm*—Learman & McCulloch

[57] ABSTRACT

Apparatus for counting containers such as empty aluminum cans comprises a loading conveyor for feeding empty containers to a counting unit having a movable conveyor underlying spaced, parallel partitions which provide a plurality of parallel pathways along which the containers are conveyed toward a discharge zone. Upstream from the discharge zone is a metering device which overlies the containers and which precludes more than one container in any row from passing the metering device at any one time. Downstream from the metering device are counters which record the number of containers discharged from the counting unit. Containers discharged from the counting unit are conveyed to an elevated level from which they are discharged to a bin for crushing and baling.

18 Claims, 7 Drawing Figures

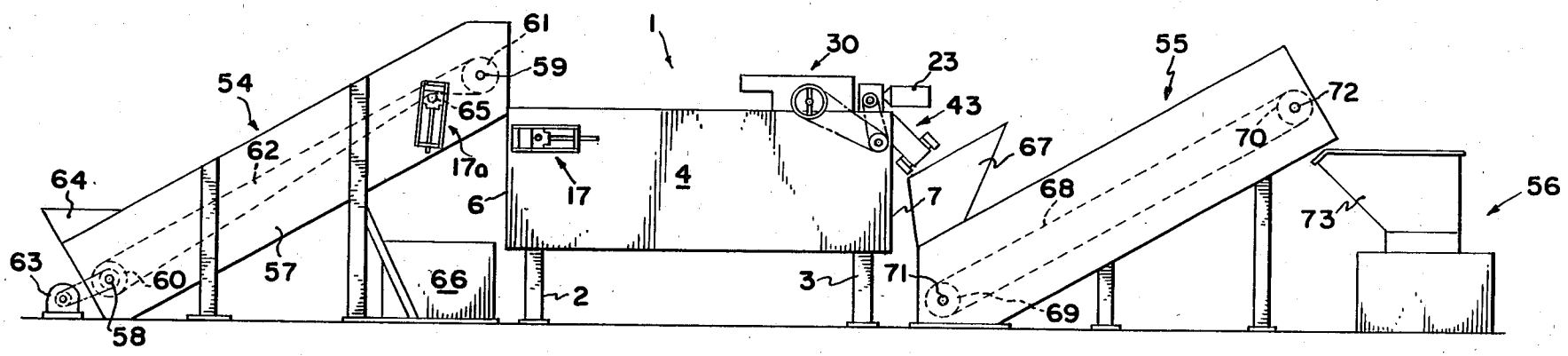
FIG.1
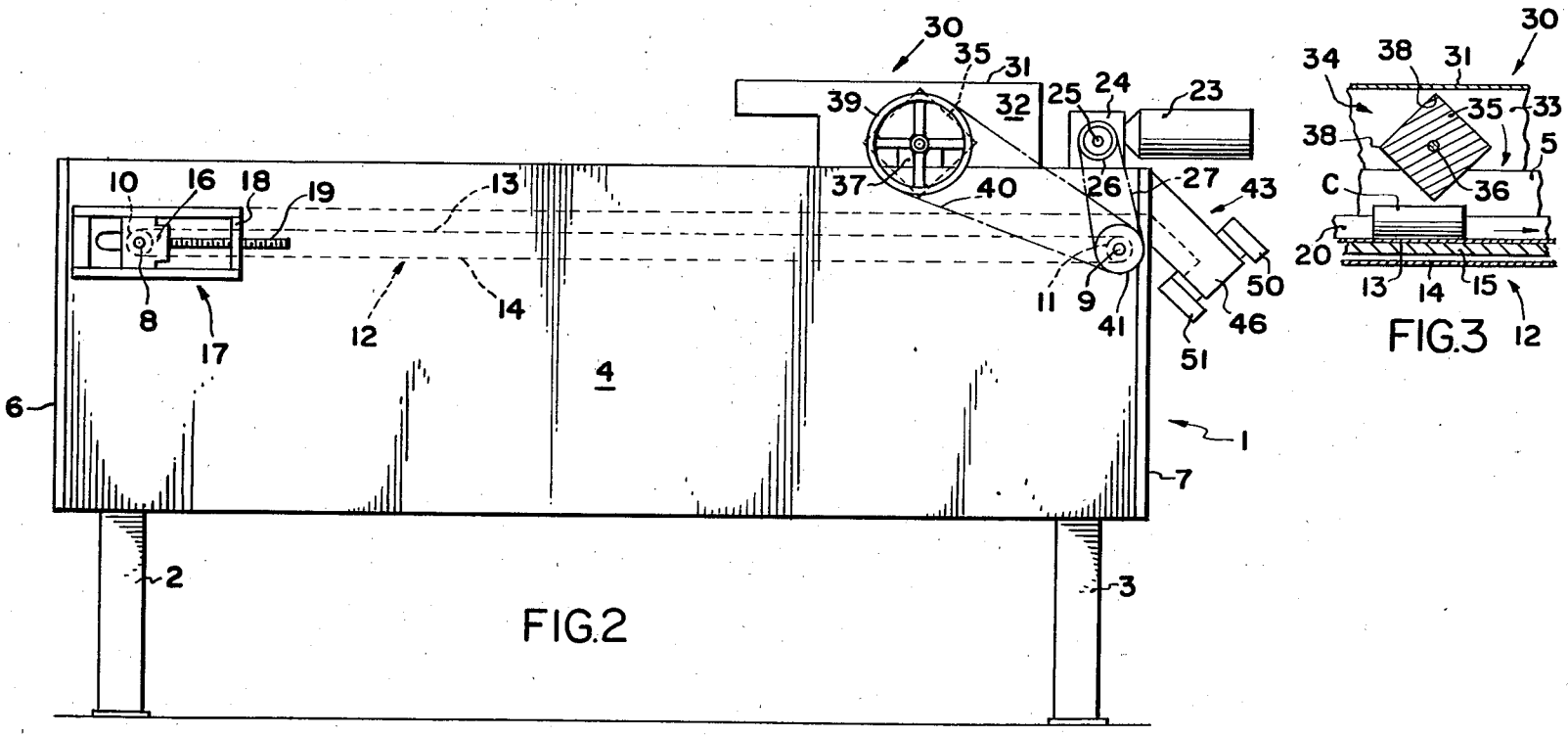
FIG.2
FIG.3

CONTAINER COUNTING APPARATUS

BACKGROUND OF THE INVENTION

In some jurisdictions of the country anti-littering laws require vendors of beverages in certain kinds of containers, such as aluminum cans, to collect a deposit for each such container. The deposit is refundable upon the return of the container to the vendor. The vendor thus may accumulate a large number of completely or partially empty containers which are sold to a reclaimer who crushes and bales or otherwise conditions the containers for delivery to a remelt installation for reclamation.

At each stage of the procedure prior to baling it in necessary to provide some manner of ascertaining the number of empty containers. Presently, two systems are predominant. In one the containers are weighed. This is not a particularly reliable system, however, for several reasons. First, not all of the containers are empty as a consequence of which the weight of particular batch of containers may be far from accurate. Second, foreign matter frequently may be adhered to or mingled with the containers. In this case the weight of a batch of containers again may be quite inaccurate.

The second predominant system in use today involves the manual counting of containers. This system also is undesirable because it is time consuming and requires the services of multiple persons, thus adding to the cost of disposing of the empty containers. Further, audits have shown that manual counting and recording of containers is not particularly accurate.

Apparatus constructed in accordance with the invention has been designed to overcome the problems associated with the container counting systems referred to above and, at the same time, result in a highly accurate count of containers using only a minimum number of personnel.

SUMMARY OF THE INVENTION

The container counting apparatus disclosed herein comprises a number of components which may or may not be used in conjunction with one another, depending upon the volume of containers counted and subsequently processed at a particular site. Not all of the components are required, however. The principal component is a counting unit which receives containers adjacent one end and conveys them toward the other end from which the containers are discharged. This unit has a conveyor and a plurality of partitions which divide the interior of the unit into a plurality of parallel rows or paths each of which is of such width between its opposite sides as to accommodate one container only. Each row leads toward the discharge end of the unit, but upstream from the discharge point is a metering device which overlies the conveyor and the partitions and the containers. The metering device has one or more sweep surfaces which periodically traverse the container rows at such level as to preclude more than a single level of containers from passing the metering device. Thus, it is not possible for two or more containers to be stacked one atop the other and pass beneath the metering device to the discharge point.

Between the metering device and the discharge end of the unit is a counting mechanism consisting of a number of counters which corresponds to the number of rows. As each container passes its associated counter the latter is actuated. Since stacked containers cannot pass the metering device, each counter can count only one container at a time. Thus, each container discharged from the counting unit is counted.

In larger installations it is desirable to incorporate apparatus for feeding empty containers automatically to the counting unit and to include additional apparatus for transferring counted containers from the counting unit to a crusher, or baler, or the like. Thus, apparatus constructed in accordance with the invention may include a loading conveyor which receives empty containers and feeds them to the counting unit. The apparatus also may include a hopper and conveyor unit for receiving containers discharged from the counting unit and delivering them to a crusher or baler or the like.

DESCRIPTION OF THE DRAWINGS

A presently preferred embodiment of the invention is disclosed in the following description and in the accompanying drawings, in which:

FIG. 1 is a largely diagrammatic, side elevational view of a number of components arranged to provide a system for counting and baling metal containers;

FIG. 2 is a side elevational view, on a greatly enlarge scale, of the container counting unit;

FIG. 3 is a sectional view illustrating a portion of the apparatus shown in FIG. 2;

DETAILED DESCRIPTION

Figure 4:
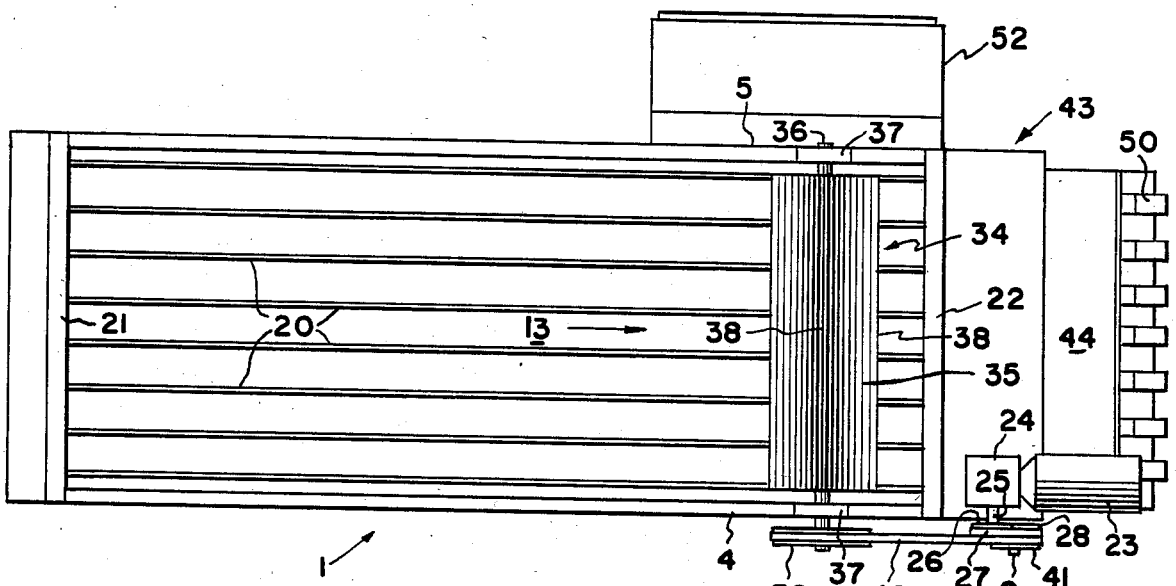
FIG. 4 is a top plan view of the counting unit.
Figure 5:
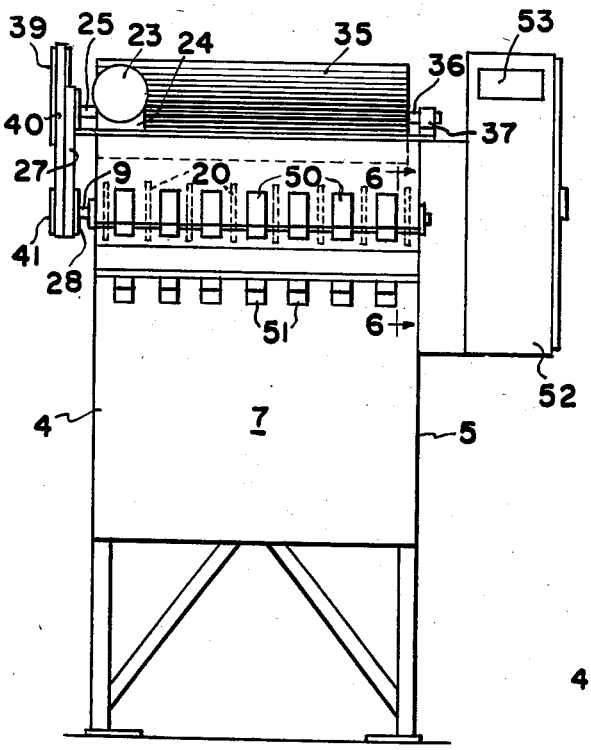
FIG. 5 is an end elevational view of the counting unit.

Apparatus constructed in accordance with the invention is adapted for use in counting empty containers, especially aluminum beverage cans. The apparatus may consist of a number of component units assembled in such manner as to constitute a complete system for handling and counting such containers. The number of units assembled in a single system may vary, but every such system will include a counting unit designated generally by the reference character 1. The counting unit comprises frame members 2 and 3 on which are supported side walls 4 and 5 and end walls 6 and 7. Spanning the side walls and journaled in bearings supported thereby are rotary shafts 8 and 9 on which are fixed turning rolls 10 and 11 around which is trained an endless conveyor belt 12 having an upper run 13 and a lower run 14. A support 15 underlies the conveyor's upper run 13 and is fixed to suitable brackets (not shown) carried by the side walls 4 and 5. Preferably, the shaft 8 of the turning roll 10 is journaled in a reciprocable block 16 forming part of a tensioning device 17 having a frame 18 through which extends a threaded adjusting screw 19. The block 16 is adjustable toward and away from the opposite turning roll 11 so as to provide more or less tension on the runs 13 and 14 of the conveyor belt 12.

The upper end of the counting unit 1 is open to provide a receptacle for loose, empty containers. However, the open area is divided into a plurality of longitudinally extending, parallel rows by means of spaced apart partitions 20 which extend longitudinally of the counting unit and over-lie the upper conveyor run 13 with suitable clearance. The partitions 20 are secured at their opposite ends to frame members 21 and 22 which span the side walls 4 and 5.

Means for driving the conveyor belt 12 comprises an electric motor 23 and a gearbox 24 from which extends a drive shaft 25. Fixed to the shaft 25 is a drive pulley 26. A drive belt 27 is trained around the pulley 26 and also about a pulley 28 (FIG. 4) that is fixed to the shaft 9. The motor 26 rotates in such direction as to cause the upper run 13 of the conveyor to move left to right, as viewed in FIG. 4. The right-hand end of the counting unit 1, therefore, is the discharge end of the conveyor.

Upstream from the discharge end of the conveyor is a removable housing 30 having a top wall 31 and opposite side walls 32 and 33 supported atop the walls 4 and 5 of the counting unit 1. Within the housing 30 is a rotary metering device 34 comprising a square rotor 35 secured to a shaft 36 that spans the walls 4 and 5 and is journaled in the bearing 37 supported on such walls. The rotor preferably is formed of or coated with a rubbery material for noise reduction purposes. Each pair of adjacent sides of the rotor 35 converge toward a point or sweep surface 38. Fixed to the shaft 36 is a drive pulley 39 around which is trained a drive belt 40 which also is trained around a pulley 41 (FIG. 2) fixed on the shaft 9 of the conveyor 12. The conveyor 12 and the rotor 35 thus are driven simultaneously and in the same direction (clockwise as viewed in FIGS. 2 and 3), but as each sweep surface 38 of the rotor traverses the container rows, it moves counter to the direction of movement of the conveyor run 13.

A container C of the kind with which the invention is concerned is illustrated in FIG. 3 as comprising a cylinder of predetermined length and diameter. Typically, a 12-ounce aluminum container C has a length of 5 inches and a diameter of 2.5 inches. Aluminum containers also are manufactured which have a capacity of 16 ounces. Such containers conventionally have a length of 7 inches and a diameter of 2.5 inches. The diameter of each size container, therefore, is uniform, but the length differs.

As is best indicated in FIG. 3, the height of each partition 20 is less than the diameter of the container C. Further, the rotor 35 of the metering device 34 is mounted at such level that no sweep surface 38 may engage either a container C lying on the conveyor run 13 or a partition 20. However, the rotor 35 is mounted at such level that each sweep surface 38 passes close to the level of the upper surface of the container C as the rotor rotates. In practice, the lowest level that each sweep surface 38 may occupy during rotation of the rotor is about 2.75 inches above the surface of the conveyor run 13, or about 0.25 inch above a container C. Thus, the counter movement of the containers on the run 13 and the sweep surfaces 38 will prevent stacked containers from passing the metering device.

Figure 6:
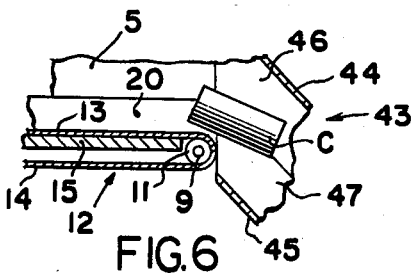
FIG. 6 is a sectional view taken on the line 6—6 of FIG. 5.

At the discharge end of the conveyor 12 is a chute 43 having a top wall 44, a bottom wall 45, and side walls 46. The walls 44 and 46 are inclined downwardly from the discharge end of the conveyor 12 at an angle of about 45°. Partitions 47 extend between the top and bottom walls of the chute 43 in prolongation of the partitions 20 and form parallel passages 48 through the chute. Containers C thus are discharged from the conveyor run 13 into the chute 43, as is indicated in FIG. 6.

Counting means designated generally by the reference character 49 is provided for counting each container C that passes through the chute 43. In the disclosed embodiment the counting means comprises a photoelectric unit for each passage 48 and each such unit includes an emitter 50 mounted on the top wall 44 above each passage 48 and a receiver 51 mounted on the bottom wall 44 under each passage 48. Each of the walls 44 and 45 is provided with an aperture through which a light beam from an emitter 50 may pass to the associated receiver. The emitters and receivers may correspond to those manufactured by Banner Engineering Corporation, Minneapolis, Minn.

Figure 7:
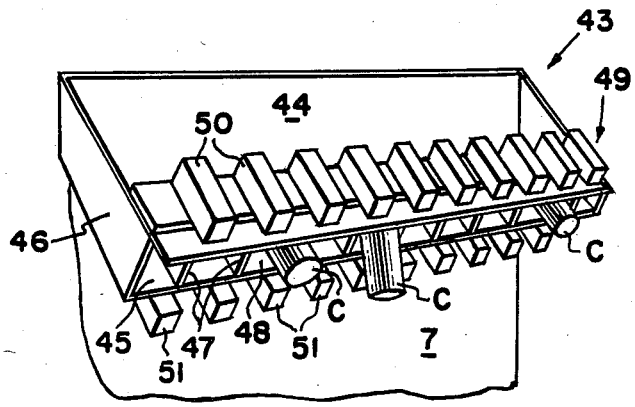
FIG. 7 is an isometric view illustrating the discharge end of the counting unit.

The individual emitters and receivers of the counting mechanism 49 are connected electrically to known apparatus located within an electrical control box 52 mounted on the side wall 5 of the counting unit 1. The electrical box has a window 53 therein through which a counter display (not shown) may be viewed. It will be understood that, each time an emitter 50 and receiver 51 cooperate to generate a photoelectric pulse, such pulse will be transmitted to the counter display which is visible through the window 53 so as to display the number of containers discharged through the chute 43. Of course, it is not necessary to utilize a display counter. Any other form of recorder may be used equally wall. The photoelectric counters preferably are of the type which generates a counting pulse each time that light beam is established between an emitter and its associated receiver. Accordingly, it is preferred that the openings in the walls 44 and 45 be so located and that the length of the latter wall be so related to the locations of the openings that, as each container emerges from the chute, its leading end dips and its trailing end rises, as is shown by the container C in FIG. 7. This will ensure a gap between the emerging container and the immediately following container. As a result, the establishment of a light beam from an emitter to its receiver will be assured and a counting pulse generated by each emerging container.

In a large installation it is preferred to associate with the counting unit 1 an elevator loading unit 54, a collecting elevator unit 55, and a baler unit 56. Although these additional units may be used if desired, they are not essential.

If the loadng unit 54 is used, it may comprise a frame 57 on which is journaled a pair of spaced shafts 58 and 59 mounting turning rolls 60 and 61, respectively, and around which is trained an endless conveyor belt 62. An electric motor 63 is coupled by a suitable drive belt and pulley arrangement to the shaft 58 so as to drive the conveyor belt.

As is illustrated in FIG. 1, the roll 61 is located at a level above that of the roll 60 so that containers introduced to a bin 64 at the lower end of the unit 54 may be conveyed upwardly for discharge to the counting unit 1 adjacent the left-hand end of the latter.

There frequently exists ferrous or other magnetically permeable debris in containers delivered to the feeding unit 54. Such debris may be diverted from the counting unit 1 if the roll 61 is magnetized to an extent sufficient to carry the magnetically permeable debris around the roll 61, rather than releasing such debris. A tensioning unit 17*a*, like the unit 17, may be associated with the conveyor and include a roller 65 in engagement with the conveyor belt 62. The roller 65 may be adjusted so as to increase or decrease the length of conveyor belt which wraps around the roll 61. As shown in FIG. 1, the conveyor 62 engages the roll 61 through about 200°, thereby ensuring retention on the belt 62 of a magnetically permeable object until such time as the object is incapable of being discharged to the unit 1. Such an object will be released as it leaves the zone of the roll 61 and may be discharged by gravity to a receptacle 66.

Containers discharged from the chute 43 of the counting unit 1 may be received in a hopper 67 of the collecting unit 55 for gravity delivery to an endless conveyor belt 68 trained around rolls 69 and 70 fixed on shafts 71 and 72, respectively, and which may be driven by any conventional means, not shown, to convey the containers upwardly for discharge by gravity into a hopper 73 which communicates with the baler 56. The counted containers, therefore, may be crushed and compressed into bales for delivery to a remelt installation.

As the containers 1 are delivered to the counting unit 1, their arrangement is haphazard. It is possible, therefore, that some containers may stand on end, span a pair of adjacent partitions, or be stacked upon each other in one or more rows. Since the conveyor 12 operates continuously, those containers which engage the upper run 13 will be moved toward the discharge chute 42. As the containers arrive at the metering device 34, any container which lies at or above the level of the lowermost sweep surface 38 will be engaged by the latter and displaced in a direction away from the metering device. There thus may be considerable agitation of containers upstream of the metering device, but eventually all of the containers will fall into the parallel rows and pass under the metering device for counting and discharge through the chute 43.

The relative rates of speed of the conveyor 12 and the rotor 35 preferably are so adjusted that the rotor completes one revolution in the time required for the conveyor run 13 to move 10 inches. Each of the shorter, 5 inch containers, therefore, will be traversed by two sweep surfaces as such container passes beneath the rotor. Thus, it is virtually impossible for two containers in the same row to pass the rotor at one time, even if one or both of such containers are partially flattened.

The disclosed embodiments are representative of presently preferred forms of the invention, but are intended to be illustrative rather than definitive thereof. The invention is defined in the claims.

We claim:

1. Apparatus for counting containers comprising movable conveyor means for supporting and moving containers in a direction leading toward a discharge zone; spaced partitions of less height than that of said containers overlying said conveyor means and defining a plurality of parallel rows, each of which has a width corresponding substantially to that of said containers; metering means overlying said partitions upstream from said discharge zone, said metering means having a sweep surface spanning all of said rows and spaced above said conveyor means a distance greater than the height of any of said containers but less than twice the height of any of said containers, thereby precluding the delivery of stacked containers to said discharge zone; and counting means for each of said rows for counting each container passing said zone in each of said rows.

2. Apparatus according to claim 1 wherein said metering means comprises a rotary member rotatable about an axis transverse to the direction of movement of said containers.

3. Apparatus according to claim 2 wherein said rotary member is multi-sided and has a plurality of said sweep surfaces circumferentially spaced from one another.

4. Apparatus according to claim 2 wherein said rotary member is square in cross-section and has four of said sweep surfaces circumferentially spaced 90° from one another.

5. Apparatus according to claim 2 including means for rotating said rotary member about said axis in a direction such that each of said sweep surfaces directly confronting said conveyor means moves in a direction opposite that in which said conveyor means moves.

6. Apparatus according to claim 1 including a chute at said discharge zone and into which each of said containers is delivered by said conveyor means, said chute being downwardly inclined from the level of said conveyor means.

7. Apparatus according to claim 6 wherein said counting means is supported by said chute.

8. Apparatus according to claim 6 wherein said counting means comprises photoelectric means.

9. Apparatus according to claim 6 wherein said chute has a container supporting surface that terminates at a level such that a container traversIng such surface rocks to provide a gap between its trailing end and the leading end of the next following container.

10. Apparatus according to claim 9 wherein said counting means comprises photoelectric means supported adjacent the termination of said supporting surface.

11. Apparatus for counting containers comprising elevator means for lifting a plurality of containers to an elevated level and discharging them therefrom; container receiving means at a level below said elevated level for receiving containers discharged from said elevator means; partition means in said receiving means for dividing the latter into a plurality of parallel rows each having a width corresponding substantially to that of said containers; conveyor means underlying said partition means for conveying containers in said rows in a direction toward a discharge zone; metering means overlying said conveyor means and spanning said rows upstream from said discharge zone, said metering means having a sweep surface located at such level with referelevator means; partition means of less height than that of said containers in said receiving means for dividing the latter into a plurality of parallel rows unobstructed at their upper ends and each having a width corresponding substantially to that of said containers; conveyor means underlying said partition means for conveying containers in said rows in a direction toward a discharge zone; metering means overlying said partition means and spanning said rows upstream from said discharge zone, said metering means having a sweep surface located at such level with reference to that of said conveyor means as to enable unstacked containers to pass said metering means and to preclude stacked containers passing said metering means; and counting means at said discharge zone for counting containers passing said metering means.

12. Apparatus according to claim 11 including a bin for receiving containers discharged from said discharge zone, and second elevator means within said bin for lifting containers out of said bin.

13. Apparatus according to claim 11 wherein said elevator means including an endless conveyor having its upper end trained around a roll, and adjusting means engaging said endless conveyor adjacent said roll for varying the angular extent that said conveyor engages said roll.

14. Apparatus according to claim 13 wherein said roll includes magnetic material operable to attract magnetically permeable objects carried by said conveyor and retain such objects on that portion of said conveyor in engagement with said roll.

15. Apparatus for counting containers comprising a conveyor for supporting and moving containers along a path leading to a discharge zone; partition means of less height than that of said containers overlying said conveyor and defining a plurality of parallel rows unobstructed at their upper ends having a width corresponding substantially to that of said container; means for driving said conveyor in a direction to move said containers along said path; a rotary metering device overlying said partition means upstream from said zone and past which said containers must move to reach said zone, said metering device having at least one sweep surface spanning said rows; means mounting said metering device at such level above said conveyor that said sweep surface has a lowermost position spaced above said conveyor a distance greater than the height of said containers but less than 1.5 times such height; means for rotating said metering device in a direction such that when said sweep surface is in its lowermost position it directly confronts said conveyor and moves in a direction opposite that in which said conveyor is driven; and counting means downstream from said metering device for counting containers passing said metering device.

16. Apparatus according to claim 15 wherein the relative speeds of movement of said metering device and said conveyor are such that each container is confronted by a sweep surface of said metering device at least twice as such container moves past said metering device.

17. Apparatus according to claim 15 including support means at said discharge zone for supporting said containers, said support means being inclined downwardly from the level of said metering device.

18. Apparatus according to claim 17 wherein said support means terminates at a level below that of said conveyor, thereby enabling said containers to rock in a vertical plane as they leave said support means.

* * * * *

UNITED STATES PATENT AND TRADEMARK OFFICE

CERTIFICATE OF CORRECTION

PATENT NO. : 4,590,364

DATED : May 20, 1986

INVENTOR(S) : Theodore R. McDonald et al

It is certified that error appears in the above-identified patent and that said Letters Patent is hereby corrected as shown below:

Column 1, line 15, change "in" to -- is --.

Column 1, line 21, before "particular" insert -- a --.

Column 2, line 24, change "enlarge" to -- enlarged --.

Column 4, line 22, change "wall" to -- well --.

Column 5, line 49, delete "," and insert -- unobstructed at their upper ends and --.

Column 5, line 58, after "means" insert -- downstream from said metering means --.

Column 5, line 59, change "zone" to --metering means --.

Column 6, line 21, change "traversIng" to -- traversing --.

Column 6, line 34, after "means" (second occurrence) insert -- of less height than that of said containers --.

Column 6, line 35, after "rows" insert -- unobstructed at their upper ends and --.

UNITED STATES PATENT AND TRADEMARK OFFICE

CERTIFICATE OF CORRECTION

PATENT NO. : 4,590,364

DATED : May 20, 1986

INVENTOR(S) : Theodore R. McDonald et al

It is certified that error appears in the above-identified patent and that said Letters Patent are hereby corrected as shown below:

Column 6, line 42, delete "with refer-".

Column 6, delete lines 43 through 52 in their entirety.

Column 6, line 53, delete -- surface located at such level --.

Column 6, line 64, change "including" to -- includes --.

Column 7, line 11, after "ends" insert -- and --.

Signed and Sealed this

Third Day of February, 1987

*Attest:*

*Attesting Officer*

DONALD J. QUIGG

*Commissioner of Patents and Trademarks*